United States Patent [19]

Loos

[11] Patent Number: 4,800,678

[45] Date of Patent: Jan. 31, 1989

[54] TILT-LOCK DEVICE

[75] Inventor: Horst Loos, Freudenberg, Fed. Rep. of Germany

[73] Assignee: Siegenia-Frank KG, Siegen, Fed. Rep. of Germany

[21] Appl. No.: 88,065

[22] Filed: Aug. 21, 1987

[51] Int. Cl.[4] ..... E05C 17/00

[52] U.S. Cl. ..... 49/394; 16/360; 16/361; 16/363; 49/192

[58] Field of Search ..... 49/191–193, 49/176, 394; 16/360, 361, 363; 292/152, DIG. 20

[56] References Cited

FOREIGN PATENT DOCUMENTS

| | | | |
|---|---|---|---|
| 2445855 | 4/1976 | Fed. Rep. of Germany . | |
| 2450243 | 5/1976 | Fed. Rep. of Germany ... | 292/DIG. 20 |
| 2255042 | 12/1976 | Fed. Rep. of Germany . | |
| 2826139 | 12/1979 | Fed. Rep. of Germany ..... | 49/192 |
| 2826179 | 12/1979 | Fed. Rep. of Germany ..... | 49/192 |
| 3008556 | 8/1980 | Fed. Rep. of Germany . | |
| 2233865 | 1/1975 | France . | |

*Primary Examiner*—Francis K. Zugel
*Assistant Examiner*—James R. Brittan
*Attorney, Agent, or Firm*—Blodgett & Blodgett

[57] ABSTRACT

A tilt-lock device 3 for rotary tilt-wing windows and doors or the like consists of a tilt-lock plate 4 with lock-webs 14, 15 sitting upon the upright frame bar in the lower frame corner at the lock side and of a locking element 11 associated with the upright wing bar at the lock side sitting at the lower end of a swivel lashing 5. The swivel lashing 5 passes with its bearing pivot 10 through an elongated slot 17 in a U-rail 6 which serves for guidance of the connecting rod 7 . The swivel lashing 5 is releasable for a limited swivel motion at least in the tilt-open switch position and when a locking element 11 engages in a tilt-lock pocket 12 of the tilt-lock plate 4. A flexible bar spring 19 sits with two laterally spaced legs **19*b*, 19*c* interconected through a web 19*a* on the one hand in a mounting support 6, 17 and is clamped on the other hand with its two legs 19*b* and 19*c* at the swivel lashing 5 at a distance from the axis of its bearing pivot 10. The mounting space required for accommodation of the flexible bar spring 19 is to be better utilized or reduced but at the same time also the initial stress effect of the flexible bar spring 19 is to be improved while reducing the manifestations of wear between the reciprocally movable functional parts. For this purpose the flexible bar spring 19 is taken up in the eleongated slot 17 of the U-rail 6 and projects hereby with the longitudinal edges of its legs 19*b* and 19*c* beyond the outside of the U-rail 6. The swivel lashing 5 is provided at its back with two parallel longitudinal grooves 20*a* and 20*b* into which engage with fit the longitudinal edges of the legs 19*b* and 19*c*.**

10 Claims, 3 Drawing Sheets

TILT-LOCK DEVICE

BACKGROUND OF THE INVENTION

The invention relates to a tilt-lock device for rotary tilt-wing windows and doors or the like, consisting of a tilt-lock plate with lock webs sitting upon the upright frame bar in the lower frame corner at the lock side and of a locking element associated with the upright frame bar at the lock side. The locking element sits at the lower end of a swivel lashing that is connected through a bearing pivot at its upper end with a connecting rod, whereby the swivel lashing passes with its bearing pivot through an elongated slot in a U-rail. The U-rail serves for guidance of the connecting rod and is releasable at least in the tilt-open switch-position for a limited swivel motion on a locking element engaging in a tilt-lock pocket in the tilt-lock plate relative to the U-rail, the connecting rod, as well as to the tilt-lock plate. A flexible bar spring sits with two laterally spaced legs connected with one another through a web on the one hand in a holding and on the other hand is clamped with its two legs at the swivel lashing at a distance from the axis of its bearing pivot.

A tilt-lock device of this kind is already known and is described for example in the DE-AS No. 30 08 556. In exactly the same design it can be used on all practically occurring tilt-open angles for the wings, thereby to secure in each case the chatter-free holding of the tilted wing and to ensure on the tilted wing the effective blocking of the fitting of the connecting rod against faulty connection on tilted wing and to serve beyond this as lift-security bolt for the tilted wing in the area of the tilt-lock.

On this known tilt-lock device the flexible bar spring is arranged lying before the outside surface of the U-rail and is thereby anchored on its one end with spacing above the swivel lashing at the connecting rod, while its other end is clamped at the swivel lashing outside of the axis of the shaft serving as bearing pivot.

The flexible bar spring requires therefore in each case before the outside of the U-rail and above the swivel lashing a free space for its accommodation, which free space must be considerably larger dimensioned in longitudinal direction of the U-rail than that free space which per se is required for the longitudinal displacement of the swivel lashing relative to the U-rail. Thus there is required for use of the flexible bar spring in work connection with the swivel lashing a free space before the free longitudinal side of the U-rail which has a length which stands against the free space needed with exclusive use of the swivel lashing in a ratio of approximately 1.6:1. In the area of this additionally required free space there can then naturally not be provided any additional working parts such as are frequently used on connecting rod fittings because through this the operation of the flexible bar spring can be effectively impaired.

Object of the invention is to provide a tilt-lock device of this class on which not only the mounting space for accommodation of the flexible bar spring is better utilized or reduced, respectively, but where at the same time the initial spring tension is improved. Beyond this there will simultaneously be minimized in practical operation all possible manifestations of wear between the mutually movable functional parts.

The invention achieves the solution of this task through the characterizing features that the flexible bar spring is taken up in the elongated slot of the U-rail and thereby projects with the longitudinal edges of its legs beyond the outside of the U-rail, and that the swivel lashing is provided on its back with two parallel longitudinal grooves into which engage and fit the longitudinal edges of the legs.

On account of this design of the tilt-lock device the legs of the flexible bar spring can lie with the largest part of their cross section within the material thickness of the U-rail and extend thus only to such a slight extent beyond their outer surface so that there is maintained on any possible switch position a durably secure form-locking engagement with the longitudinal grooves in the back of the swivel lashing.

A further developing feature of the invention is that the flexible bar spring is taken up stationarily or immovably in the elongated slot of the U-rail and that thereby the swivel lashing is provided with its longitudinal grooves slidingly movable relative to the legs of the bar spring.

The invention further provides that the web of the flexible bar spring abuts at the upper end of the elongated slot of the U-rail while the free ends of its legs are facing towards the lower end of this elongated slot.

The tilt-lock device of the invention is further distinguished in that the legs of the flexible bar spring run in rest position parallel to one another and that the elongated slot is provided on both longitudinal edges in the lower longitudinal area in each case with two bulges or enlargements defined against each other through a lug. The longitudinal area of the longitudinal edges are provided with the bulges or enlargements and can thereby extend approximately over the two lower thirds of the length of the elongated slot whereby the greatest width of the elongated slot in the area of the bulges may stand to the normal with of the elongated slot in a ratio of about 1.25:1.

The lugs which limit the bulges or enlargements against each other are advantageously located in that longitudinal area of the elongated slot in which the bearing pivot of the swivel lashing stands on tip-switch position of the connecting rod.

The invention is further characterized in that, that the legs of the flexible bar spring display a rectangular cross section standing upright relative to the plane of the U-rail, and consist of wear-resistant material, e.g. spring-hard steel.

Finally a tilt-lock device of the invention is further characterized in that a bump of curved contours projects into the lower end of the elongated slot of the U-rail.

BRIEF DESCRIPTION OF THE DRAWINGS

An exemplified embodiment of the invention is explained hereunder with the aid of the drawing in detail. There shows FIG. 1 in elevation a tilt-lock device in its switch position serving for tip-opening of the wing; however the wing still lies in lock position at the stationary frame, FIG. 2 a presentation corresponding to FIG. 1, whereby the wing has a tilt position relative to the stationary frame which does not correspond to the largest possibly occurring tilt-opening angle, FIG. 3 in lateral view and partly in section the tilt-lock device according to the FIGS. 1 and 2, FIG. 4 on a larger scale the functional cooperation of swivel lashing, flexible bar spring and U-rail in the corresponding tilt position of the wing in FIG. 2, and FIG. 5 a cut along the line V—V in FIG. 4.

DESCRIPTION OF THE PREFERRED EMBODIMENT

Figure 3:
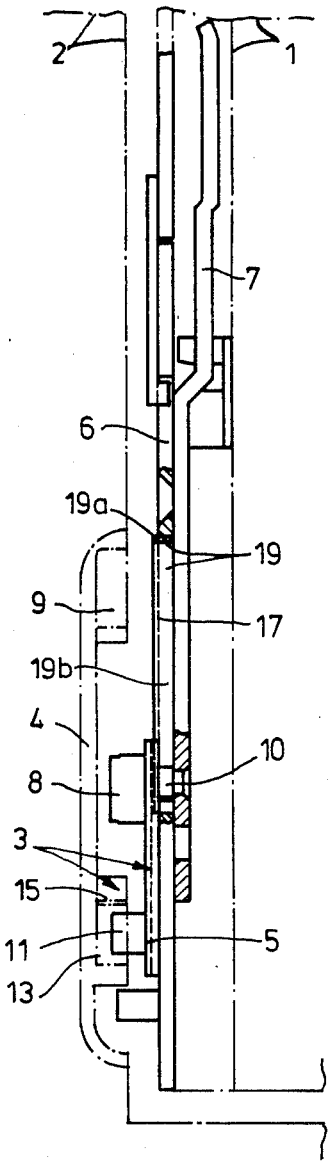

In the drawing is presented in dot-dash-lines a window which displays a wing 1 and a stationary frame 2, whereby a tilt-lock device 3 is installed between them. This tilt-lock device 3 shows a tilt-lock plate 4 at the stationary frame 2 and a swivel lashing 5 at the wing 1.

Figure 5:
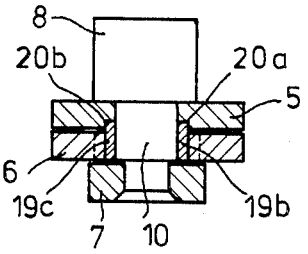

The swivel lashing 5 is movably guided at the U-rail 6 of a so-called edge-gear at whose back is located a connecting rod 7. This U-rail is preferably provided with a flat rectangular cross-section as shown in FIG. 5.

With this connecting rod 7 is connected a closure plug 8 which can be inserted in closure position of the wing 1 between two webs 9 of the tilt-lock plate 4 and which thereby locks the wing 1 in its closure position at the stationary frame 2.

The swivel lashing 5 is pivotally connected with the connecting rod 7 by means of the closure plug 8, and this by means of a shaft 10 which carries it.

Near its lower end the swivel lashing 5 carries a profiled cam 11 which has a form symmetric to its longitudinal median plane, for example a square shape, and which interacts with a pocket 12 at the tilt-lock plate 4 which likewise displays a form that is symmetrical to its longitudinal median plane and which has, at least in its upper part, a downwardly convergent wedge shape.

The lower narrow part 13 of the pocket 12 is coordinated in its dimensions with slight play to the outer contour of the profiled cam 11, while its upper wedge-shapely enlarging part 14 is limited by two lugs 15 which sort of act as constrictions.

Figure 1:
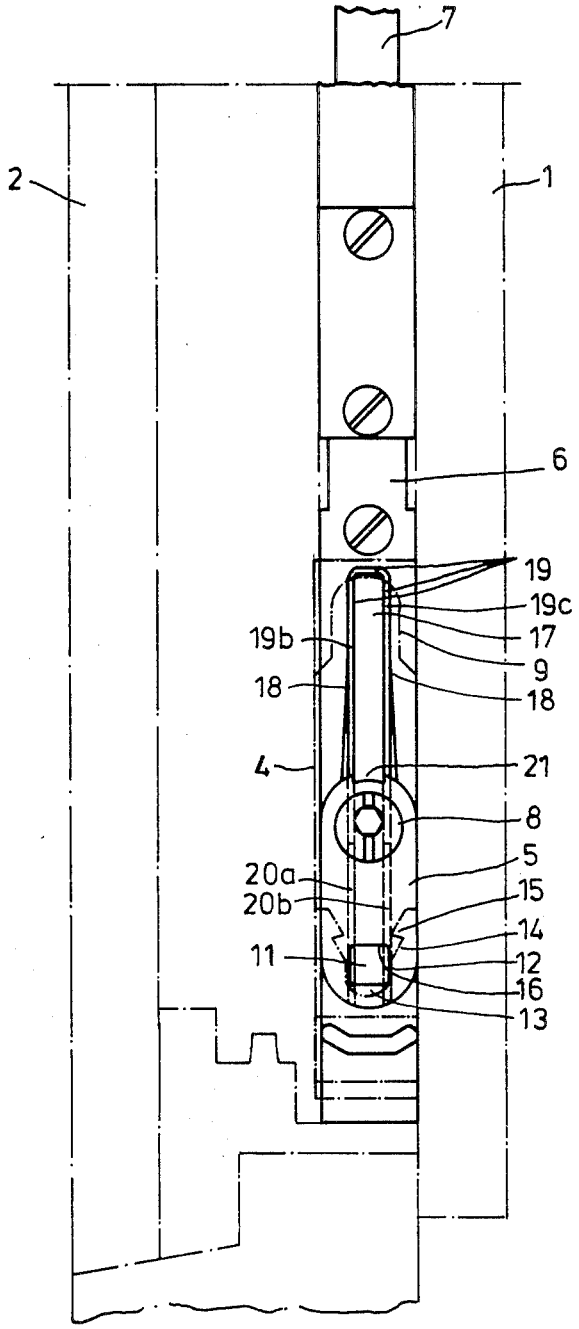
Figure 2:
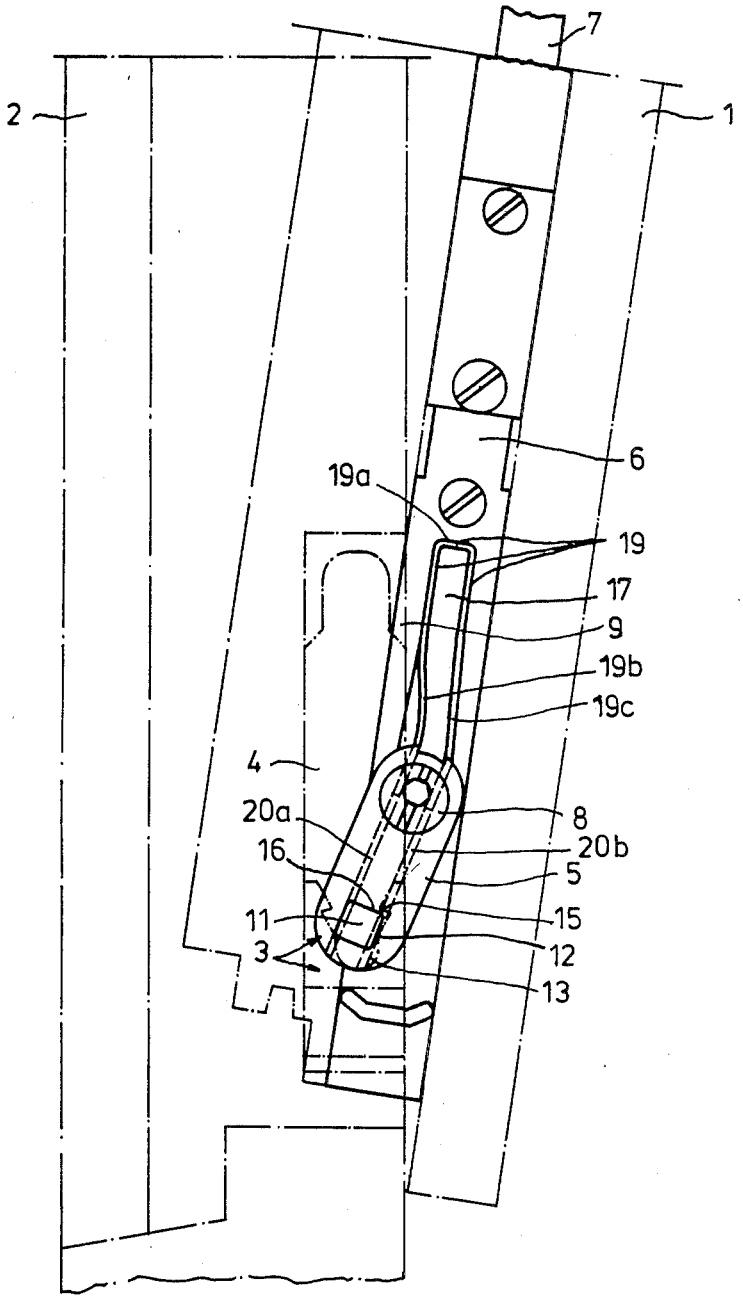

Passing through between the lugs 15 the profiled cam 11 is pushed with the aid of the swivel lashing 5 that carries it into the pocket 12 as long as the wing 1 remains still in the closure position at the stationary frame 2 as can be seen from FIG. 1. The wing 1 can then be brought into tilt position whereby the swivel lashing 5 is brought from its parallel position to the U-rail 6 shown in FIG. 1 into a swing-out position recognizable in FIG. 2. The profiled cam 11 slightly rises from the lower part 13 of the pocket 12 and comes to rest below the lugs 15 against the flanks of the enlargement 14 of the pocket 12.

The upper transverse edge 16 of the profiled cam 11 swings slightly under one of the lugs 15 and prevents through this an inadvertent or undesirable wrong connection of the tilt-lock device 3 through the connecting rod 7.

Through the symmetrical shaping of all parts of the predetermined longitudinal median planes of the tilt-lock device 3 is ensured an optional right and left utilization of them although the pocket 12 is molded onto the tilt-lock plate 4 in one piece.

The shaft 10 connecting the closure plug 8 and the swivel lashing 5 with the connecting rod 7 penetrates an elongated slot 17 in the U-rail 6 in such a way that it is movable between the two longitudinal edges 18 of them over its whole length.

Approximately over the upper third of the total length of the elongated slot 17 its longitudinal edges 18 run a rectilinear, parallel course **18*a* while they are provided in the thereon downwardly adjoining longitudinal area successively in each case with a bulge or enlargement 18*b*, a lug 18*c* and another bulge or enlargement 18*d***.

While the lugs **18*c* are so shaped in each case that its top lies in direct line with the parallel sections 18*a* of the longitudinal edges 18 the bulges or enlargements 18*b* and 18*d* are so shaped that at their lowest point the elongated slot 17 has in each case a width which compares to the width of the parallel longitudinal sections 18*a*** at a ratio to of about 1.25:1.

The bulges or enlargements **18*b* of the longitudinal edges 18 link up with their areas 18*a* at first under an acute angle rectilinearly divergent while subsequent thereto they are guided from the lowest point with a relatively large radius convergent to the top of the lug 18*c***.

The bulges or enlargements **18*d* extend under an acutely angled course again from the top of the lugs 18*c* downwardly away, whereby however the angle of tilt is made considerably larger than in the area of the rectilinearly divergent sections of the bulges or enlargements 18*b***.

The bulges or enlargements **18*d* have however on the other hand only a fraction of the length of the bulge 18*b***.

Figure 4:
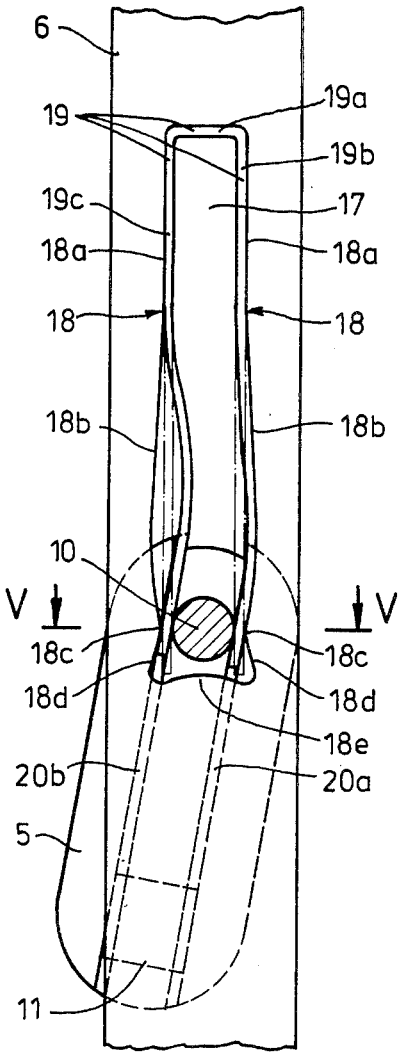

The particular shaping of the elongated slot 17 in the U-rail 6 can be clearly seen in FIG. 4 of the drawing. But here can also be recognized that the bulges or enlargements **18*d* run out with relatively large transition radii in a bump 18*e* which projects with slight curvature into the lower end of the elongated slot 17** of the U-rail.

In the elongated slot 17 of the U-rail 6 is inserted a flexible bar spring 19 which shows legs **19*b* and 19*c* which are connected with one another in one piece through a web 19*a***.

The flexible bar spring 19 has hereby a rectangular material cross section and is so inserted in the elongated slot 17 that this rectangular cross section stands upright transverse to the plane of the U-rail 6 and projects by a small degree, for example at most 1 mm, beyond the outer broadside of the U-rail 6. Its remaining cross sectional height of at least 2 mm is however taken up in the enlongated slot 17 across the material thickness of the U-rail 6.

The flexible bar spring 19 has in any case such an arrangement within the elongated slot that its web **19*a* finds a supporting abutment at its upper end while the free ends of their legs 19*b* and 19*c* are facing the lower end of the elongated slot 17 and come to rest in direct neighborhood of the bump 18*e***.

The two legs **19*b* and 19*c* of the flexible bar spring 19 receive their lateral support on the one hand at the mutually parallel running sections 18*a* in the upper third of the elongated slot 17 and on the other hand at a certain distance above their free ends once more through the lugs 18*c***.

In relaxed, that is, in rectilinearly proceeding state the legs **19*b* and 19*c* of the flexible bar spring 19 lie however in the area of the bulges or enlargements 18*b* and 18*d* of the elongated slot 17 not at its longitudinal edges 18**.

The mutually facing inner surfaces of both legs **19*b* and 19*c* of the flexible bar spring 19 form also the lateral guide for the shaft 10 of the closure plug 8** co-utilized as bearing pivot for the swivel lashing and contribute hereby—because of their smooth surfaces and their great hardness—to the minimization of the manifestations of wear between the mutually movable functional components.

With the two legs 19*b* and 19*c* of the flexible bar springs 19 the swivel lashing 5 acts through two parallelly proceeding longitudinal grooves 20*a* and 20*b* together, formed into its back, into which grooves the legs 19*b* and 19*c* engage with form-locking fit. On a displacement of the bearing pivot or of the shaft 10, respectively, by means of the connecting rod 7 along the U-rail 6 there shifts the swivel lashing 5 with its longitudinal grooves 20*a* and 20*b* along the legs 19*b* and 19*c* of the flexible bar spring 19. In the totally upwardly raised position of the swivel lashing the legs 19*b* and 19*c* of the flexible bar spring 19 are at least almost over the whole length of the swivel lashing 5 in holding and guiding engagement with their longitudinal grooves 20*a* and 20*b*. In the central switch position of the swivel lashing 5 the guide engagement between the legs 19*b* and 19*c* of the flexible bar spring 19 and also the longitudinal grooves 20*a* and 20*b* of the swivel lashing 5 still extends for more than one half its length. The legs 19*b* and 19*c* serve hereby as parallel guidance for the swivel lashing 5. On the other hand if the swivel lashing 5 is brought into its lower switch position (see FIGS. 1, 2 and 4) then the two legs 19*b* and 19*c* of the flexible bar spring 19 are now only in form-locking engagement in the longitudinal area of the swivel lashing 5 adjacent to the bearing pivot or shaft 10 with their longitudinal grooves 20*a* and 20*b*.

In the lower switch position of the swivel lashing 5 its bearing pivot or shaft 10 lies with its longitudinal axis upon a plane which is approximately coincident with the tops of the two lugs 18*c* near to the lower end of the elongated slot 17 in the U-rail 6. When now through the tilt-opening of the wing 1 the swivel lashing 5 which is engaged through its profiled cams 11 with the pocket 12 of the tilt-lock plate 4 is brought from its parallel position to the U-rail into a sloping position thereto then there results an elastic deformation at the two legs 19*b* and 19*c* of the flexible bar spring 19. This is effected through the longitudinal grooves 20*a* and 20*b*, located in the underside of the swivel lashing 5, in interaction with the lugs 18*c* at the longitudinal edges 18 of the elongated slot 17 of the U-rail 6 as can be seen from the FIG. 4. The angular displacement of the swivel lashing 5 relative to the U-rail 6 therefrom takes place against the action of a relatively strong restoring force of the legs 19*b* and 19*c* of the flexible bar spring 19. Through this there is brought about on each tilt-opening position of the wing 1 relative to the stationary frame 2 a tilt-holding free from play and chatter through the tilt-lock device 3.

The bulges or enlargements 18*b* and 18*d* at the longitudinal edges 18 of the elongated slot 17 of the U-rail allow the bending deformations resulting from the angular displacement of the swivel lashing 5 relative to the U-rail 6 at the legs 19*b* and 19*c* of the flexible bar spring 19 to the necessary extent and thereby durably ensure the orderly function of the whole tilt-lock device 3.

The bump 18*e* projecting into the lower end of the elongated slot 17 of the U-rail 6 with a radius of crown ensures that the free ends of the two legs 19*b* and 19*c* of the flexible bar spring 19 can return again and again into their orderly resting position as soon as the swivel lashing 5 attempts to take up its parallel position to the U-rail 6.

The swivel lashing 5 is further provided at its upper end with a release mechanism 21 which has (relative to the longitudinal grooves 20*a* and 20*b*) such an arrangement and design in the back of the swivel lashing 5 that in the upper switch position of the swivel lashing 5 it can take up without any problem the web 19*a* of the leg spring 19 which connects in one piece the two legs 19*b* and 19*c*.

The above described construction of a tilt-lock device 3 for rotary tilt-wing windows and doors or the like has the special advantage that all functionally necessary component parts can be manufactured, with relatively little expenditure, out of a stable material, especially steel, so that there will be achieved a high functional reliability and wear resistance with the lowest possible mounting space. Beyond this, there is then also given the possibility to manufacture the individual parts of stainless steel qualities and to permit through this the use of the fittings also in an aggressive environment.

I claim:

1. A tilt-lock device for rotary/tilt windows and doors and the like having upright frame elements and upright wing elements, comprising:

(a) a tilt-lock plate in a frame element having an upper portion with lock webs and a lower portion containing a pocket with lugs, (b) a swivel lashing on the wing element adjacent the frame element, the swivel lashing carrying a profile cam at a lower end and a closure plug having a shaft at an upper end, the cam and the plug facing towards the frame element, the swivel lashing further provided with two elongated grooves facing towards the wing element, (c) a connecting rod on the wing element connected to the swivel lashing through the closure plug at one end and at the other end connected to a control mechanism, (d) a U-rail on the wing element between the swivel lashing and the wing element, the U-rail carrying an elongated slot having two longitudinal edges and an upper end and a lower end, the surface of the U-rail defining a plane and the elongated slot being provided with two enlarged areas in the area of the lower end, separated from each other by a lug on each longitudinal edge, and (e) a cross-sectionally flat, rectangular flexible bar spring in the elongated slot of the U-rail, the spring having two longitudinal legs and a connecting web, the edges of the legs extending slightly beyond the edges of the elongated slot toward the frame element and engaging the elongated grooves on the swivel element.

2. A tilt-lock device as recited in claim 1, wherein the flexible bar spring is held fast within the elongated slot of the U-rail and guides the swivel lashing in a sliding movable manner by engaging the longitudinal legs of the spring in the elongated grooves on the swivel element.

3. A tilt-lock device as recited in claim 2, wherein the web of the flexible bar spring abuts at the upper end of the elongated slot of the U-rail while the free ends of the legs of the spring face towards the lower end of the elongated slot.

4. A tilt-lock device as recited in claim 3, wherein the flexible bar spring is configured to have parallel legs when in relaxed position.

5. A tilt-lock device as recited in claim 1, wherein the area in which the two enlargements is located extends over approximately the two thirds of the length of the elongated slot containing the lower end.

6. A tilt-lock device as recited in claim 5, wherein the largest width of the elongated slot in the area of the enlargements stands to the width of the elongated slot outside of the area of the enlargements in a ratio of approximately 1.25:1.

7. A tilt-lock device according to claim 6, wherein the device is configured to allow an adjustment of the connecting rod and swivel lashing which permits a tilt opening having a bearing pivot point, in which the lugs of the elongated slot between the enlargements are located in the same longitudinal area of the elongated slot as the bearing pivot point when the device is in the tilt-adapted position.

8. A tilt-lock device as recited in claim 1, wherein the legs of the flexible bar spring have a rectangular cross-section relative to the plane defined by the surface of the U-rail and are constructed of abrasion resistant material.

9. A tilt-lock device according to claim 1, wherein a curved bump projects into the lower end of the elongated slot of the U-rail, whereby the free ends of the two legs of the flexible bar spring return to their orderly resting position when the swivel lashing takes up a position parallel to the U-rail.

10. Tilt-lock device for rotary tilt-wing windows and doors or the like, consisting of a tilt-lock plate with lock webs sitting upon an upright frame bar in a lower frame corner at a lock side, and of a locking element associated with an upright wing bar at the lock side, which sits at a lower end of a swivel lashing which is connected through a bearing pivot at its upper end with a connecting rod, whereby the swivel lashing passes with its bearing pivot through an elongated slot in a U-rail which serves for guidance of the connecting rod, and is releasable at least in a tilt-open switch-position for a limited swivel motion on a locking element engaging in a tilt-lock pocket in the tilt-lock plate relative to the U-rail, connecting road as well as tilt-lock plate, and wherein a flexible bar spring sits with two laterally spaced legs connected with one another through a web on the one hand in a mounting support and is clamped on the other hand with its two legs at the swivel lashing at a distance from the axis of its bearing pivot, characterized by the fact that, the flexible bar spring (19) is partially taken up in the elongated slot (17) of the U-rail (6) and protrudes with the longitudinal edges of it legs (19*b* and 19*c*) beyond the outside of the U-rail (6), that the swivel lashing (5) is provided at its back with two parallel longitudinal grooves (20*a* and 20*b*), into which the longitudinal edges of the legs (19*b* and 19*c*) fittingly engage, and that the elongated slot (17) is provided on both longitudinal edges (18) in the lower longitudinal region in each case with mutually limited enlargements (18*b* and 18*d*) separated by a lug (18*c*) from which the legs (19*b*, 19*c*) of the flexible bar spring (19) take up a spacing in their slack resting position.

* * * * *